US011846413B2

(12) United States Patent
Joergensen

(10) Patent No.: US 11,846,413 B2
(45) Date of Patent: Dec. 19, 2023

(54) ILLUMINATION DEVICE LIGHT COLLECTOR AND CONVERGING OPTICAL SYSTEM

(71) Applicant: HARMAN PROFESSIONAL DENMARK APS, Aarhus N (DK)

(72) Inventor: Dennis Thykjaer Joergensen, Roende (DK)

(73) Assignee: Harman Professional Denmark APS, Aarhus N (DK)

( * ) Notice: Subject to any disclaimer, the term of this patent is extended or adjusted under 35 U.S.C. 154(b) by 0 days.

(21) Appl. No.: 17/792,382

(22) PCT Filed: Jan. 13, 2020

(86) PCT No.: PCT/EP2020/050702
§ 371 (c)(1),
(2) Date: Jul. 12, 2022

(87) PCT Pub. No.: WO2021/143998
PCT Pub. Date: Jul. 22, 2021

(65) Prior Publication Data

US 2023/0049483 A1 Feb. 16, 2023

(51) Int. Cl.
*F21V 5/00* (2018.01)
*F21S 10/00* (2006.01)
(Continued)

(52) U.S. Cl.
CPC ..... *F21V 5/008* (2013.01); *F21S 10/007* (2013.01); *F21W 2131/406* (2013.01); *F21Y 2115/10* (2016.08)

(58) Field of Classification Search
CPC ..... F21V 5/008; F21V 9/08; F21S 10/007; F21Y 2115/10; F21W 2131/406
See application file for complete search history.

(56) References Cited

U.S. PATENT DOCUMENTS 8,770,800 B1 * 7/2014 Yriberri ..... F21K 9/60 362/302
2012/0257386 A1 * 10/2012 Harbers ..... F21K 9/64 362/235

(Continued)

FOREIGN PATENT DOCUMENTS

EP 3282180 A1 2/2018

OTHER PUBLICATIONS

International Search Report and Written Opinion, PCT/EP/2020/050702, dated Oct. 1, 2020, 11 pages.

*Primary Examiner* — Bao Q Truong
(74) *Attorney, Agent, or Firm* — Artegis Law Group, LLP

(57) ABSTRACT

There is presented a light fixture (200) comprising an nation device (244) comprising a plurality of light sources (103) emitting light along an optical axis (247); an optical gate (242) arranged along the optical axis; a light collector (241) placed between the plurality of light sources (103) emitting and the optical gate (242) and adapted to collect light from the light sources and adapted to project at least a part of said light along said optical axis (247); and one or more color filters (251, 253), such as color filters for subtractive color mixing, such as dichroic filters or color gels or the like, such as arranged to be traversed by the optical axis (247), placed between the light collector (241) and the optical gate (242), and a converging optical component (263), such as a first converging optical component (263), placed between the one or more color filters (251, 253) and the optical gate (242) and further comprising an optical projecting system (243) placed on the opposite side of the optical gate (242) with respect to the plurality of light sources (103) and adapted to collect at least a part of the light emittable from the illumination device and adapted to project at least a part of said light along said optical axis (247).

19 Claims, 3 Drawing Sheets

(51) Int. Cl.
*F21Y 115/10* (2016.01)
*F21W 131/406* (2006.01)

(56) References Cited

U.S. PATENT DOCUMENTS

| | | | | |
|---|---|---|---|---|
| 2018/0045390 | A1* | 2/2018 | Campetella | F21S 10/007 |
| 2019/0219249 | A1* | 7/2019 | David | H05B 45/20 |
| 2019/0219429 | A1 | 7/2019 | David et al. | |

* cited by examiner

ILLUMINATION DEVICE LIGHT COLLECTOR AND CONVERGING OPTICAL SYSTEM

CROSS-REFERENCE TO RELATED APPLICATIONS

The present application is a national stage application of the international application titled "ILLUMINATION DEVICE LIGHT COLLECTOR AND CONVERGING OPTICAL SYSTEM," filed on Jan. 13, 2020, and having application number PCT/EP2020/050702. The subject matter of this related application is hereby incorporated herein by reference.

TECHNICAL FIELD

The present invention relates to a light fixture, such as a light fixture comprising a number of light sources generating light and a light collecting means adapted to collect the generated light and to convert the collected light into a number of light beams that propagate along an optical axis, and more particularly to a light fixture with one or more color filters, and furthermore relates to a corresponding method and use.

BACKGROUND

Light fixtures, such as moving heads, may be utilized, for creating various light effects and/or mood lighting in connection with, e.g., concerts, live shows, TV shows, sport events or as architectural installation light fixtures creating various effects. Typically entertainment light fixtures creates a light beam having a beam width and a divergence and can for instance be wash/flood fixtures creating a relatively wide light beam with a uniform light distribution or it can be profile fixtures adapted to project an image onto a target surface.

It might generally be considered advantageous for light fixtures to be able to emit light at a high luminance, be able to change a color of the emitted light and/or to accomplish good colour mixing.

Hence, an improved light fixture capable of emitting light at a high luminance, capable of changing a color of the emitted light and/or capable of accomplishing good colour mixing.

SUMMARY

It may be seen as an object of the present invention to provide an light fixture, method and/or use for with a capability of emitting light at a high luminance, a capability of changing a color of the emitted light and/or a capability of accomplishing good colour mixing, such as in case of subtractive color mixing. It is a further object of the present invention to provide an alternative to the prior art.

Thus, the above described object and several other objects are intended to be obtained in a first aspect of the invention by providing a light fixture (200) comprising:

an illumination device (244) comprising:

a plurality of light sources (103) emitting light along an optical axis (247);

an optical gate (242) arranged along the optical axis;

a light collector (241) placed between the plurality of light sources (103) and the optical gate (242) and adapted to collect light from the light sources and adapted to project at least a part of said light along said optical axis (247); and one or more color filters (251, 253), such as color filters for subtractive color mixing, such as dichroic filters or color gels or the like, such as arranged to be traversed by the optical axis (247), placed between the light collector (111) and the optical gate (242), and a (first) converging optical component (263), such as a first converging optical component (263), placed between the one or more color filters (251, 253) and the optical gate (242)

and further comprising an optical projecting system (243) placed on the opposite side of the optical gate (242) with respect to the plurality of light sources (103) and adapted to collect at least a part of the light emittable from the illumination device and adapted to project at least a part of said light along said optical axis (247).

The invention may be particularly, but not exclusively, advantageous for obtaining a light fixture for emitting light at a high luminance and/or a high luminous efficacy. The high luminance and/or high luminious efficacy may be achieved by the illumination system exhibiting a high efficiency, which may in turn be enabled via the converging optical component, such as a first converging optical component, placed between the one or more color filters and the optical gate. Such converging optical component may enable relaxing the requirements for the light collector and/or may together with the light collector be able to collect more light from the light sources and convey it to the optical gate. For example, rather than requiring that the light collector converges light from the light sources to the optical gate, it is possible that collimated or even diverging light having traversed the light collector can be collected by the such convering optical component and brought to the optical gate with large high efficiency, such as a light source-to-optical gate efficiency of above 40%, such as at least 42%, such as at least 44%, such as at least 46%, such as at least 48%, such as at least 50%.

The invention may additionally and/or alternatively, but not exclusively, be advantageous in that the converging optical component, such as a first converging optical component, placed between the one or more color filters and the optical gate may provide light to the optical gate having a half angle less than 27°, such as less than 26°, such as less than 25°, such as less than 24°, such as less than 23°, such between 22° and 23°.

The invention may additionally and/or alternatively, but not exclusively, be advantageous for obtaining a light fixture for emitting light at a high luminance even in case of a colour filter being present between the light collector and the optical gate. Without such converging optical component, such color filter limits the luminance due to a reflection of light back into the light collector in a somewhat focused form (e.g., due to a light collector focusing on the optical gate so that reflected light ends up being somewhat focused within the light collector), such as with increased illuminance. However, having converging power via the (first) converging optical component placed between the one or more color filters and the optical gate allows the light to be less (as compared to a system without the converging optical system) convergent, such as even collimated or even divergent, at the surface of the color filter, which entails that reflected light does not become focused at the light collector (i.e., illuminance may become lower), which in turn reduces or mitigates a risk of detrimental heating of the light collector (which may, for example, be a polymer, such as Poly(methyl methacrylate) (PMMA)). In other words, the back-reflected light from the color filter, such as a colour mixing flag, may form a larger spot/area on the light collector, leading to less thermal stress of the light collector, and possibly also the light sources, compared to a light fixture with an illuminations system without the converging optical component placed between the one or more color filters and the optical gate.

The invention may additionally and/or alternatively, but not exclusively, be advantageous for improving colour mixing, in particular because having the converging optical component placed between the one or more color filters and the optical gate enables keeping the one or more color filters out, such as far out, of focus, such as farther out of focus than the actual mechanical distance would dictate without the converging optical component placed between the one or more color filters and the optical gate. As it will be discussed in further details below the Abbe number of the glass of the converging optical component may advantageously be above 70.

By 'light fixture' is understood an electrical device that contains an (electrical) light source, such as an illumination system with a light source, that provides illumination and wherein the light source and optionally one or more optical components is at least partially enclosed in a housing. The person skilled in (entertainment) light fixtures realizes that a number of light effects can be integrated into the light fixture. According to embodiments, there is presented a light fixture with one or more of a prism for prism effects, an iris for iris effects, framing blades for framing effects, frost filter for frost effects, means for dimming effects, animation wheel for animation effects, one or more gobo wheels. The (entertainment) light fixture can be controlled based on an input signal indicative of light parameters which can be indicative of a target color indicating a decried color of the outgoing light, a number of light effect parameters indicative of a various numbers of light effects. The (entertainment) light fixture may comprise a processor configured to control the different light effects of the light fixture based on the light parameters received by the input signal. For instance the (entertainment) light fixture may comprise the light effects and be controlled based on various parameters as described in WO2010/145658 in particular on page 4 line 11-page 6 line 9.

By 'illumination device' is understood as a device for providing light through an optical gate, such a circular beam of light with certain diameter at the gate and a certain (beam) angle. The illumination device may be understood to comprise light sources and optics for providing a beam with required parameters at the gate.

'Light source' is understood as is common in the art, and may generally be an electric light source converting electrical power into luminous flux, such as a Light Emitting Diode (LED), such as a converted LED, such as a phosphor converted LED. The number of light sources in the plurality of light sources may be at least 10, such as at least 20, such as at least 40, such as at least 60, such as at least 80, such as at least 100, such as 120 or more.

By 'optical gate' is understood a plane (orthogonal to the optical axis) where optics (e.g., the light collector) of the illumination device is configured to concentrate and/or focus beams of light from the light sources and/or that the optical gate is a physical/mechanical aperture (i.e., such as the optical gate being a physical aperture placed in or close to a plane wherein beams of the light sources are focused, such as wherein 'close to' implies being placed within a distance from the fictitious plane deviating no more than 20% or 15% or 10% or 5% of the distance between the light source and the plane), such as a beam shaping device.

By 'light collector' may be understood an optical component or system capable of redirecting light, such as receiving (collecting) light with having a direction and reemitting light in another direction, such as comprising one or more (refractive) lenses and/or (reflecting) catoptres. The 'light collector' may in particular be arranged for providing diverging, collimated or converging light, such as arranged for receiving light with a certain (wide) angle, such as within ±90°, from the light sources and reemitting a beam with, respectively, a positive angle (such as at least 1°, such as at least 2°, such as at least 5°), a substantially zero angle (such as within ±15°, such as within ±10°, such as within ±5°, such as within ±2°, such as within ±1°), such as a negative angle (such as less than −1°, such as less than −2°, such as less than −5°). The light collector may comprise a number of lenslets each collecting light from one of the LEDs and converting the light into a corresponding light beam or the light collector also can be embodied as a single optical lens.

When referring to (beam) angle, it is understood throughout this application to be an angle $\theta_{1/2}$ between the optical axis and the most wide-angled optical rays (which exit the light fixture, such as passes through the exit pupil).

By 'lenslet' may be understood a lens (of any size, and optionally small) in an array.

'Color filters' are understood as is common in the art, such as a (sheet) of transparent material that modifies a light beam by selective absorption or reflection of some colours in relation to others. The color filter may be given by dichroic filters or color gels or the like. The color filters may be graduated and/or be implemented via one or more colour wheels.

By 'converging optical component' may be understood any optical component with converging power, such as one or more (refractive) lenses and/or (reflecting) catoptres.

By 'optical projecting system' may be understood a system configured to project the light passing through an optical gate along a primary optical axis. The optical projecting system may comprise a positive number of optical components and the optical projecting system may be configured to collect light modified by the beam shaping object and project the light collected along the primary optical axis. The projecting system can be configured to adjust the beam width and/or divergence of the light beam exiting the optical projecting system and can be adjusted to image a beam shaping object arranged near an optical gate at a target surface. The optical projecting system can comprise, such as consist of or be used interchangeably with, an optical zoom group and/or an optical focus group, such as wherein the optical zoom group comprises at least one optical component and is configured to adjust the divergence and/or width of the light beam and/or wherein the optical focus group comprises at least one optical component and is configured to focus the image of the beam shaping object at a target surface along the primary optical axis. The optical projecting system can be provided as a fixed group of optical components having a predefined focusing and zoom properties. The at least one optical component of the optical zoom group and/or the optical focus group can be any optical component known in the art of optical such as lenses, prisms, reflectors, etc. It is further noticed that some of the optical components can be movable in relation to the primary optical axis.

'Luminous efficacy' is understood as is common in the art and in particular understood the ratio of luminous flux to power consumption.

According to an embodiment, there is presented a light fixture wherein the light collector is arranged so that light from the plurality of light sources is diverging; such as less diverging, subsequent, such as immediately subsequent, to passing the light collector. A possible advantage of this is that more light can be collected with the light collector (compared to a situation where the light is converging subsequent to the light collector), which may in turn lead to a higher source-to-gate efficiency (where 'gate' is used interchangeably with 'optical gate' throughout the present text). Having one more converging optical components between the light collector and the optical gate may ensure that the light is converging or focused at the optical gate.

According to an embodiment, there is presented a light fixture wherein the light collector is arranged so that light from the plurality of light sources is substantially collimated, such as collimated, subsequent, such as immediately subsequent, to passing the light collector. A possible advantage of this is that more light can be collected with the light collector (compared to a situation where the light is converging subsequent to the light collector), which may in turn lead to a higher source-to-gate efficiency (where 'gate' is used interchangeably with 'optical gate'). Having one more converging optical components between the light collector and the optical gate may ensure that the light is converging or focused at the optical gate.

According to an embodiment, there is presented a light fixture comprising a (second) converging optical component, such as a second converging optical component, placed between the one or more color filters and the light collector. A possible advantage may be that a (first) converging optical component can be placed between the one or more color filters and the optical gate so that converging power after the one or more color filters enables that the color filters can be kept out of focus and that a (second) converging optical component placed between the one or more color filters and the light collector enables increasing source-to-gate efficiency, e.g., because it can be placed close to the light collector so as to both collect a large amount of light (even if the light is diverging after the light collector) and optionally being able do so in a space-efficient manner because the proximity to the light source enables that the diameter of the (second) converging optical component placed between the one or more color filters (251, 253) and the light collector (241) can be kept limited, such as substantially similar to the light collector or slightly larger, such as a diameter being within 120%, such as within 110%, such as within 105%, of a diameter of the light collector. The one or more color filters (251, 253) may comprise a variable color filters, such as cyan, yellow and/or magenta color filters. Moreover, one or more color temperature correctors (CTCs) and fixed color wheels may be be provided.

According to an embodiment, there is presented a light fixture wherein a distance from the plurality of light sources (103) to the converging optical component (263) placed between the one or more color filters (251, 253) and the optical gate (242) is 25 cm (centimeters) or less, such as 20 cm or less, such as 18 cm or less, such as 16 cm or less, such as 14 cm or less, such as 13 or less, such as 12 cm or less, such as 11 cm or less, such as 10 cm or less, such as 9 or less, such as 8 cm or less, such as 7 cm or less, such as 6 cm or less, such as 5 cm or less. A distance between the light collector (241) and the converging optical component (265) shall be kept as short as possible, such as below 5 mm, such as below 4 mm, such as below 3 mm, such as below 2 mm, such as around 1 mm, in order to keep the beam diameter and the light fixture length down, while, at the same time, maintaining a high efficiency. The distance between the two converging optical components (263, 265) should also be kept as short as possible for the same reason, such as below 44 mm, such as below 42 mm, such as below 40 mm, 38 mm, such as below 36 mm, such as between 32-34 mm. A possible advantage may that this may enable a short light fixture.

According to an embodiment, there is presented a light fixture wherein a diameter of the converging optical component (263) placed between the one or more color filters (251, 253) and the optical gate (242) is within [1; 25] cm (centimeters), such as within [2; 20] cm, such as within [5; 15] cm, such as within [8; 12] cm, such as around 10 cm, such as 96 mm. A possible advantage may that this may enable compact, yet effective light fixture.

According to an embodiment, there is presented a light fixture wherein the converging optical component, such as a first converging optical component, placed between the one or more color filters and the optical gate comprises optical material with an Abbe number above 60, such as above 62, such as above 64, such as above 66, such as above 68, such as above 70. According to an embodiment, there is presented a light fixture wherein the converging optical component, such as a second converging optical component, placed between the one or more color filters and the light collector comprises an optical material with an Abbe number above 60, such as above 62, such as above 64, such as above 66, such as above 68, such as above 70.

According to an embodiment, there is presented a light fixture wherein the converging optical component, such as a first converging optical component, placed between the one or more color filters and the optical gate comprises, such as consists of, one or more aspherical converging lenses. According to an embodiment, there is presented a light fixture wherein the converging optical component, such as a second converging optical component, placed between the one or more color filters and the light collector comprises, such as consists of, one or more aspherical converging lenses. An advantage of employing aspherical lenses may be that optical properties, such as source-to-gate efficiency may be improved relative to spherical lenses.

According to an embodiment, there is presented a light fixture wherein the converging optical component), such as a first converging optical component, placed between the one or more color filters and the optical gate comprises one or more plano-aspherical converging lenses having a Conic constant above 0, such as above 1, such as above 2, such as above 3, such as above 4, such as above 5. According to an embodiment, there is presented a light fixture wherein the converging optical component, such as a second converging optical component, placed between the one or more color filters and the light collector comprises one or more plano-aspherical lenses having a Conic constant below 0, such as below −1, such as below −2, such as below −3, such as below −4, such as below −5.

According to an embodiment, there is presented a light fixture wherein the illumination device comprises one or more lenses, such as the first converging optical component and/or the second converging optical component, with an anti-reflective (AR) coating. An advantage of employing anti-reflective coating may be that optical properties, such as source-to-gate efficiency may be improved relative to, e.g., uncoated optical components.

According to an embodiment, there is presented a light fixture wherein the illumination device provide light to the optical gate having a half angle less than 27°, such as less than 26°, such as less than 25°, such as less than 24°, such as less than 23°, such between 22° and 2°.

According to an embodiment, there is presented a light fixture wherein the illumination device is capable of delivering at least 10 klm, such as at least 20 klm, such as at least 30 klm, such as at least 40 klm, out of the light fixture. In order to deliver for example 40 klm out of the light fixture, around 49 klm may be required at the optical gate.

According to an embodiment, there is presented a light fixture wherein an optical (source-to-gate) efficiency of the illumination device, such as from the light sources to the optical gate, is above 40%, such as equal to or above 42%, such as equal to or above 44%, such as equal to or above 46%, such as equal to or above 48%, such as equal to or above 50%.

According to an embodiment, there is presented a light fixture wherein the light collector comprises a plurality of lenslets adapted to collect light from the light sources and adapted to convert the collected light into a plurality of light beams so that the light beams propagate along said optical axis, where each of said lenslets comprises an entrance surface where said light enters the lenslet and an exit surface where the light exits the lenslet.

According to an embodiment, there is presented a light fixture wherein the plurality of lenslets in the light collector form a one-piece molded glass element comprising a flange adapted for mechanical fixsation of the light collector.

According to an embodiment, there is presented a light fixture wherein each lenslet in the plurality of lenslets is a total internal reflection (TIR) lens or wherein the plurality of lenslets comprises two arrays of plano aspherical lenses on top each other, such as wherein said two arrays form a collimating optical system. The two arrays of plano aspherical lenses may form a one-piece molded glass element, such as a one-piece molded Pyrex element. A possible advantage is improved luminous efficacy of the illumination device, e.g., due to TIR lenses being able to collecting light from high angles of emittance up to ±90°, such as for collimation. As an alternative, each lenslet in the plurality of lenslets is a standard lens element, an aspherical freeform element, a collimating mixer rod, a round or square compound parabolic concentrator (CPC), a Fresnel lens or a combination of the mentioned. As another alternative the array of collimating elements could comprise, such as consist of, combinations of different types of collimating elements placed at different positions in the array.

According to an embodiment, there is presented a light fixture wherein the light fixture is a moving head (302). A moving head may be understood to be a light fixture with rotating means, such as actuators, for rotating a direction of light emitted from the illumination device around one or two axes being orthogonal to the direction of light emitted from the illumination device. An example of such embodiment may be given by a moving head, such as described in WO2010/145658A1 (see for example FIGS. 1-2 and accompanying description).

According to an embodiment, there is presented a light fixture, such as a moving head, comprising one or more actuators, such as electric motors, such as stepper motors and/or servo motors, for changing a direction of light emitted from the light fixture, such as for rotating a direction of light emitted from the illumination device around one or two axes being orthogonal to the direction of light emitted from the light fixture. A possible advantage is that the direction of light can be changed in an automated manner, which may in particular be relevant for, e.g., theatre lighting, e.g., for stage performances. An example of such embodiment may be given by a moving head, such as described in WO2010/145658A1 (see for example FIGS. 1-2 and accompanying description).

According to an embodiment, there is presented a light fixture wherein an illuminance of each light source of the plurality of light sources may be above 250 lm/mm$^2$, such as above 300 lm/mm$^2$, such as above 400 lm/mm$^2$, such as above 500 lm/mm$^2$. For, e.g., profile light or other Etendue limited applications, source illuminance may be important and relevant for how high and output can be reached for a certain size fixture. Illuminance is understood to be for DC operation (not flash) and measured in lumen (lm) per square millimeter (mm$^2$).

According to a second aspect there is presented a method of illuminating with a light fixture according to the first aspect, comprising emitting light from the plurality of light sources.

According to third aspect there is presented use a light fixture according to the first aspect, for illumination.

BRIEF DESCRIPTION OF THE DRAWINGS

The first, second and third aspect according to the invention will now be described in more detail with regard to the accompanying figures. The figures show one way of implementing the present invention and is not to be construed as being limiting to other possible embodiments falling within the scope of the attached claim set.

DETAILED DESCRIPTION

Figure 1:
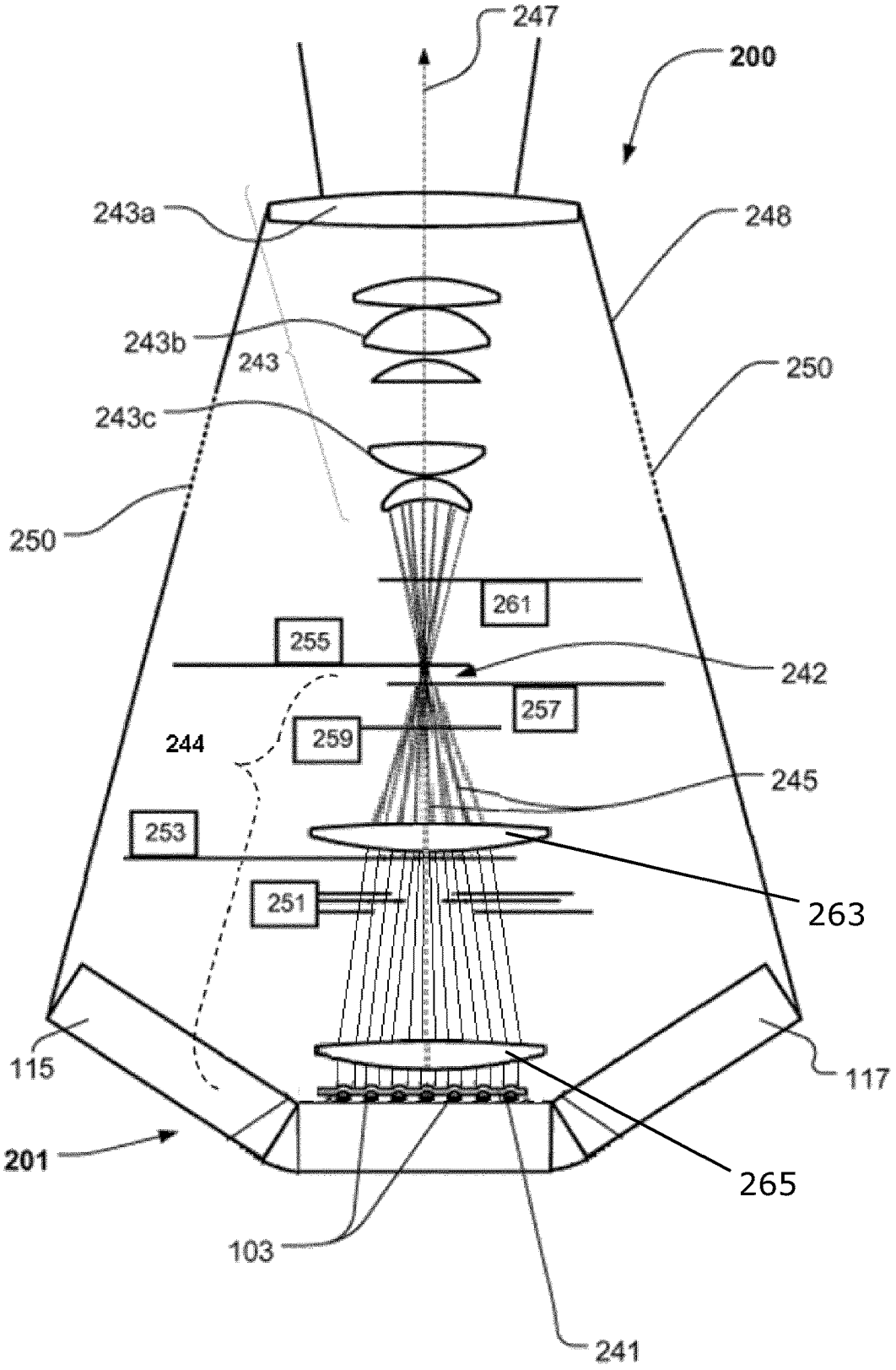
FIG. 1 shows a light fixture 200 comprising an illumination device 244.

FIG. 1 shows a light fixture 200 comprising an illumination device 244, wherein the illumination device comprises a plurality of LEDs 103, a light collector 241, an optical gate 242 and an optical projecting and zoom system 243. The light collector 241 is adapted to collect light from the LEDs 103 and to convert the collected light into a plurality of light beams propagating along an optical axis 247 (dash-dotted line). The light collector can be embodied as any optical means capable of collecting at least a part of the light emitted by the LEDs and convert the collected light to light beams. In the illustrated embodiment the light collector comprises a number of lenslets each collecting light from one of the LEDs and converting the light into a corresponding collimated light beam (in other embodiments it could be diverging). However it is noticed that the light collector also can be embodied as a single optical lens, a Fresnel lens, a number of TIR lenses (total reflection lenses), a number of light rods, arrays of lenses arranged on top of each other or combinations thereof. It is understood that light beams propagating along the optical axis contain rays of light propagating at an angle, e.g. an angle less that 45 degrees to the optical axis. The figure furthermore shows one or more color filters 251, 253, including color filters 251 for a CMY subtractive color mixing system, arranged to be traversed by the optical axis (247), placed between the light collector (241) and the optical gate (242). In case the one or more color filters 251, 253 comprise a static color filter arranged on a wheel this particular color filter may be positioned between the first converging optical component 263 and the optical gate. Still further the figure shows a (first) converging optical component 263, such as a first converging optical component 263, placed between the one or more color filters 251, 253 and the optical gate 242. Still further, the figure shows a (second) converging optical component 265, such as a second converging optical component 265, placed between the one or more color filters 251, 253 and the light collector 241. The light collector and the converging optical components 263, 265 may be configured to fill the optical the gate 242 with light from the light sources 103 so that the area, i.e. the aperture, of the gate 242 is illuminated with a uniform intensity or optimized for max output. The gate 242 is arranged along the optical axis 247. The optical projecting system 243 may be configured to collect at least a part of the light beams transmitted through the gate 242 and to image the optical gate at a distance along the optical axis. For example, the optical projecting system 243 may be configured to image the gate 242 onto some object such as a screen, e.g. a screen on a concert stage. A certain image, e.g. some opaque pattern provided on a transparent window, an open pattern in a non-transparent material, or imaging object such as GOBOs known in the field of entertainment lighting, may be contained within the gate 242 so that that the illuminated image can be imaged by the optical projecting system. Accordingly, the illumination device 200 may be used for entertainment lighting. In the illustrated embodiment the light is directed along the optical axis 247 by the light collector 241 and passes through a number of light effects before exiting the illumination device through a front lens 243*a*. The light effects can for instance be any light effects known in the art of intelligent/entertainments lighting for instance, a CMY color mixing system 251, color filters 253, gobos 255, animation effects 257, iris effects 259, a focus lens group 243*c*, zoom lens group 243*b*, prism effect 261, framing effects (not shown), or any other light effects known in the art. The mentioned light effects only serves to illustrate the principles of an illuminating device for entertainment lighting and the person skilled in the art of entertainment lighting will be able to construct other variations with additional or less light effects. Further it is noticed that the order and positions of the light effects can be changed. The illumination device comprises a cooling module 201 with first 115 and second 117 blowers. The light fixture comprises a lamp housing 248 provided with a number of openings 250.

Figure 2:
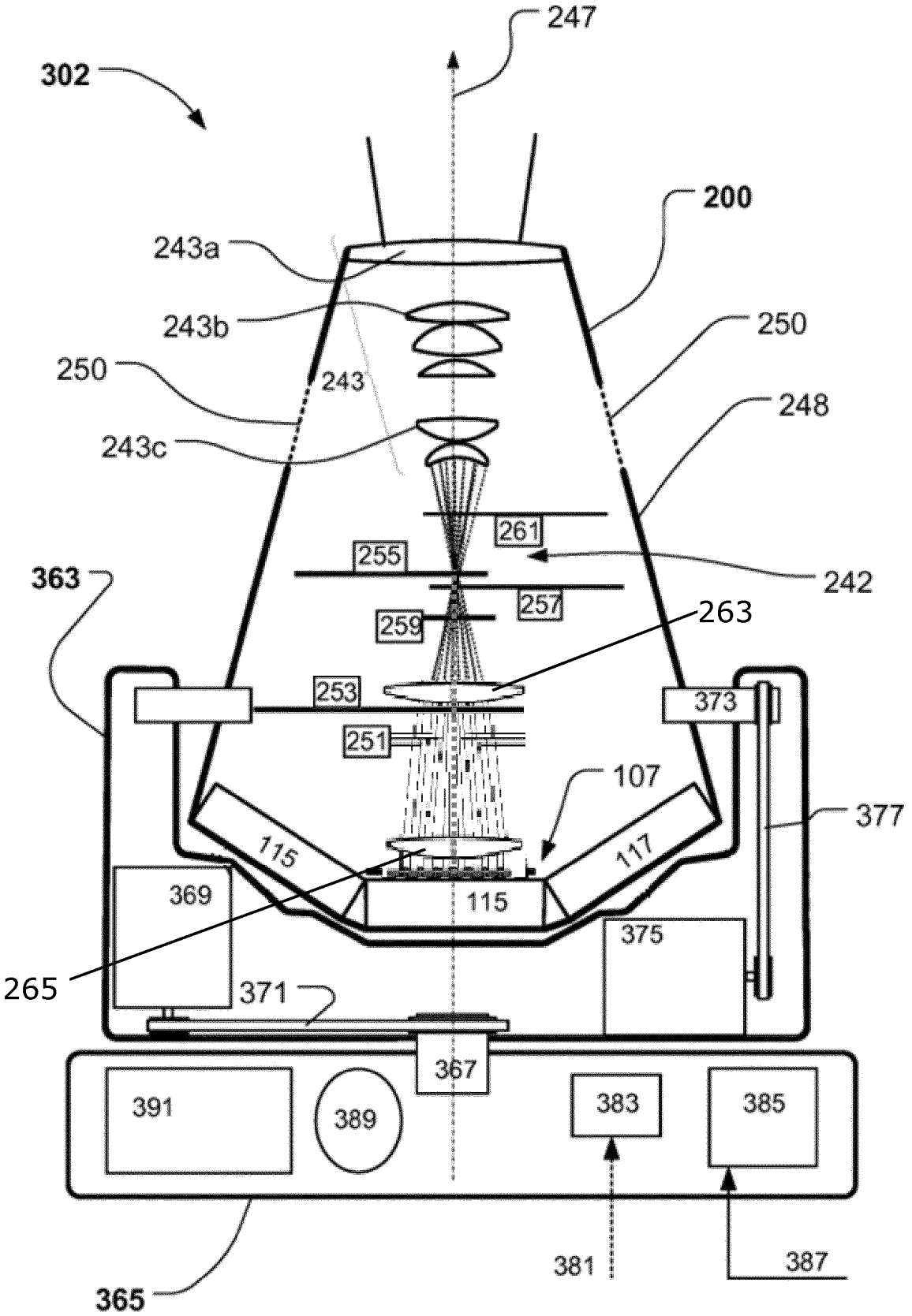
FIG. 2 illustrates a structural diagram of a moving head light fixture 302.

FIG. 2 illustrates a structural diagram of a moving head light fixture 302 comprising a head 200 rotatably connected to a yoke 363 where the yoke is rotatably connected to a base 365. The head is substantially identical to the light fixture shown in FIG. 1 and substantial identical features are labeled with the same reference numbers as in FIG. 1 will not be described further. The moving head light fixture comprises pan rotating means for rotating the yoke in relation to the base, for instance by rotating a pan shaft 367 connected to the yoke and arranged in a bearing (not shown) in the base). A pan motor 369 is connected to the shaft 367 through a pan belt 371 and is configured to rotate the shaft and yoke in relation to the base through the pan belt. The moving head light fixture comprises tilt rotating means for rotating the head in relation to the yoke, for instance by rotating a tilt shaft 373 connected to the head and arranged in a bearing (not shown) in the yoke). A tilt motor 375 is connected to the tilt shaft 373 through a tilt belt 377 and is configured to rotate the shaft and head in relation to the yoke through the tilt belt. The skilled person will realize that the pan and tilt rotation means can be constructed in many different ways using mechanical components such as motors, shafts, gears, cables, chains, transmission systems, bearings etc. Alternatively it is noticed that it also is possible to arrange the pan motor in the base and/or arrange the tilt motor in the head. The space between the yoke and the bottom part of the head is limited as the moving head light fixture is designed to be as small as possible. As known in the prior art the moving head light fixture receives electrical power 381 from an external power supply (not shown). The electrical power is received by an internal power supply 383 which adapts and distributes electrical power through internal power lines (not shown) to the subsystems of the moving head. The internal power system can be constructed in many different ways for instance by connecting all subsystems to the same power line. The skilled person will however realize that some of the subsystems in the moving head need different kind of power and that a ground line also can be used. The light source will for instance in most applications need a different kind of power than step motors and driver circuits. The light fixture comprises also a controller 385 which controls the components (other subsystems) in the light fixture based on an input signal 387 indicative light effect parameters, position parameters and other parameters related to the moving head lighting fixture. The controller receives the input signal from a light controller (not shown) as known in the art of intelligent and entertainment lighting for instance by using a standard protocol like DMX, ArtNET, RDM etc. Typically the light effect parameter is indicative of at least one light effect parameter related to the different light effects in the light system. The controller 385 is adapted to send commands and instructions to the different subsystems of the moving head through internal communication lines (not shown). The internal communication system can be based on a various type of communications networks/systems. The moving head can also comprise user input means enabling a user to interact directly with the moving head instead of using a light controller to communicate with the moving head. The user input means 389 can for instance be bottoms, joysticks, touch pads, keyboard, mouse etc. The user input means can also be supported by a display 391 enabling the user to interact with the moving head through a menu system shown on the display using the user input means. The display device and user input means can in one embodiment also be integrated as a touch screen.

Figure 3:
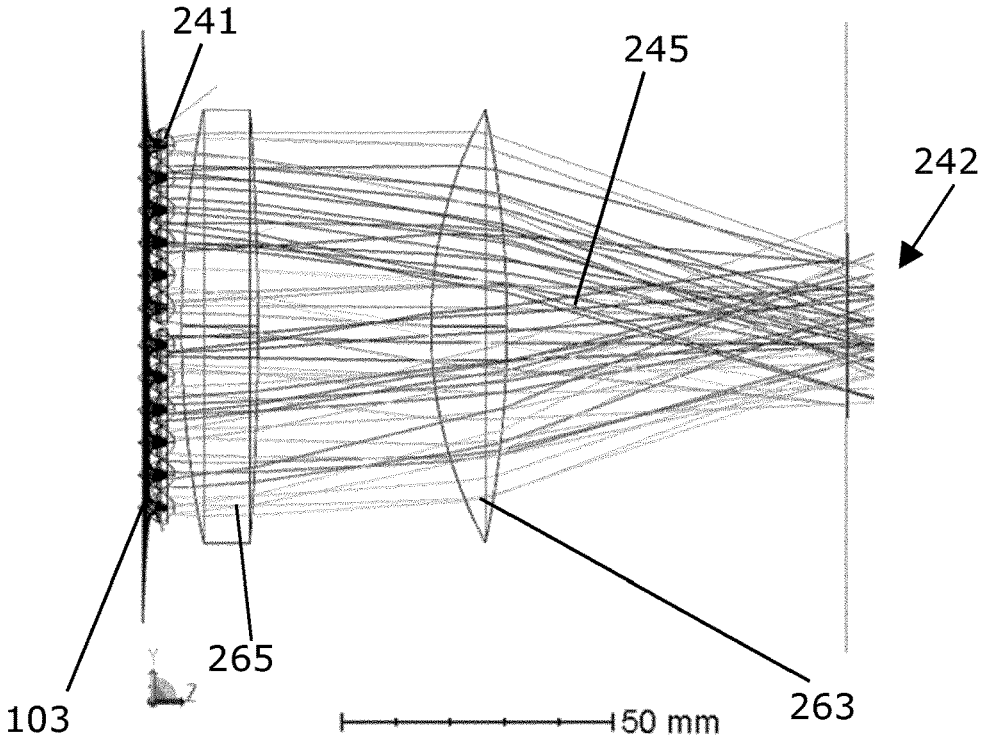
FIG. 3 and FIG. 4 each shows details of a light fixture.
Figure 4:
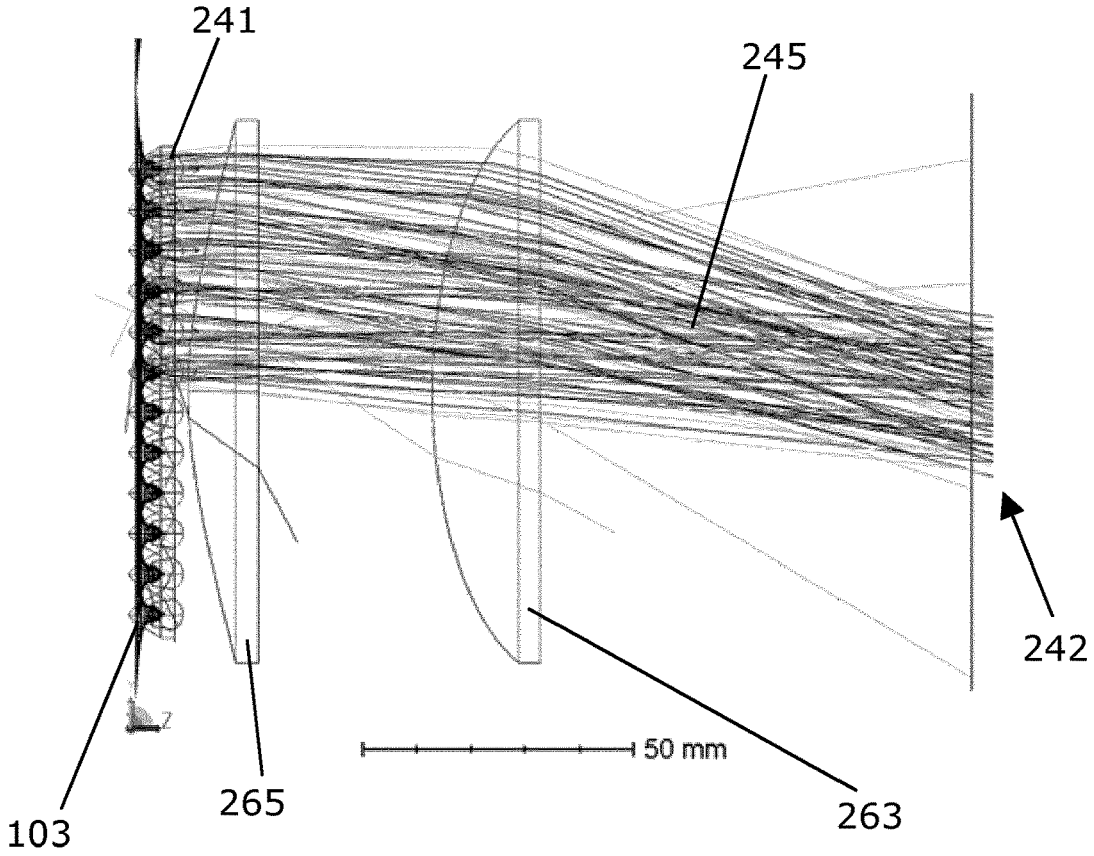

Each of FIG. 3 and FIG. 4 shows details of a light fixture, and more particularly a plurality of light sources 103 (in the form of 120×10 W LEDs) emitting light along an optical axis, an optical gate 242 arranged along the optical axis, a light collector 241 placed between the plurality of light sources 103) and the optical gate 242 and adapted to collect light from the light sources and adapted to project at least a part of said light along said optical axis 247, a (first) converging optical component 263, such as a first converging optical component 263, placed between the one or more color filters (not shown) and the optical gate 242, a (second) converging optical component 265, such as a second converging optical component 265, placed between the one or more color filters (not shown) and the light collector 241. A distance between the converging optical components 263, 265 is 32 mm, but is in general dictated by mechanical needs.

FIG. 3 more particularly shows a light collector (103) in the form of an Ø72.8 mm (diameter) array of 120×Ø6 mm (diameter) collimating Poly(methyl methacrylate) TIR lenses, one for each LED. The converging optical components 263, 265 are each a Ø80 mm (diameter) converging borosilicate glass lens, such as of type Pyrex or Supprax. Glass types B270 and H-K9L are also suitable glass candidates. A distance from the light sources to the optical gate is 130 mm. The beam characteristics at the optical gate is:

Beam diameter Ø32 mm, beam (half) angle $\theta_{1/2}$=22°. Optical source to gate efficiency is 50% (with AR coating on the converging optical components 263, 265) or 40% (without AR coating on the converging optical components 263, 265).

FIG. 4 more particularly shows a light collector (103) in the form of an Ø90.4 mm (diameter) array of 120×Ø7.45 mm (diameter) collimating Poly(methyl methacrylate), such as HT-121 TIR lenses, one for each LED. The converging optical components 263, 265 are each a Ø100 mm (diameter) converging borosilicate glass lens, such as of type H-K9L. A distance from the light sources to the optical gate is 150 mm. A distance from the (first) converging optical component 263, such as the first converging optical component 263, placed between the one or more color filters (not shown) and the optical gate 242 to the optical gate is approximately 79 mm. Preferably, the converging optical components 263, 265 each comprises a plano-aspheric converging lens having an Abbe number being larger that 70. The beam characteristics at the optical gate is: Beam diameter Ø32 mm, beam (half) angle $\theta^{1/2}$=22°. Optical source to gate efficiency is 52% (without AR coating on the converging optical components 263, 265) or 59% (with AR coating on the converging optical components 263, 265).

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A light fixture comprising:

an illumination device comprising:

a plurality of light sources emitting light along an optical axis, an optical gate arranged along the optical axis, a light collector placed between the plurality of light sources and the optical gate and adapted to collect light from the plurality of light sources and adapted to project at least a part of said light along said optical axis, one or more color filters arranged to be traversed by the optical axis, placed between the light collector and the optical gate, and a first converging optical component placed between the one or more color filters and the optical gate, a second converging optical component placed between the one or more color filters and the light collector; and an optical projecting system placed on an opposite side of the optical gate with respect to the plurality of light sources and adapted to collect at least a part of the light emittable from the illumination device and adapted to project at least a part of said light along said optical axis.

2. The light fixture according to claim 1, wherein the light collector is arranged so that light from the plurality of light sources is diverging subsequent to passing the light collector.

3. The light fixture according to claim 1, wherein the light collector is arranged so that light from the plurality of light sources is substantially collimated passing the light collector.

4. The light fixture according to claim 1, wherein a distance from the plurality of light sources to the first converging optical component placed between the one or more color filters and the optical gate is 25 cm or less.

5. The light fixture according to claim 1, wherein a diameter of the first converging optical component placed between the one or more color filters and the optical gate is between 1 and 25 cm.

6. The light fixture according to claim 1, wherein the first converging optical component placed between the one or more color filters and the optical gate comprises an optical material with an Abbe number above 60.

7. The light fixture according to claim 1, wherein the second converging optical component placed between the one or more color filters and the light collector comprises an optical material with an Abbe number above 60.

8. The light fixture according to claim 1, wherein the first converging optical component placed between the one or more color filters and the optical gate comprises one or more aspherical converging lenses.

9. The light fixture according to claim 1, wherein the second converging optical component placed between the one or more color filters and the light collector comprises one or more aspherical converging lenses.

10. The light fixture according to claim 1, wherein the first converging optical component placed between the one or more color filters and the optical gate comprises one or more plano-aspherical converging lenses having a Conic constant above 0.

11. The light fixture according to claim 1, wherein the second converging optical component placed between the one or more color filters and the light collector comprises one or more plano-aspherical lenses having a Conic constant below 0.

12. The light fixture according to claim 1, wherein the illumination device comprises one or more lenses with an anti-reflective (AR) coating.

13. The light fixture according to claim 1, wherein the illumination device provides light to the optical gate having a half angle less than 27 degrees.

14. The light fixture according to claim 1, wherein the illumination device is capable of delivering at least 10 klm.

15. The light fixture according to claim 1, wherein an optical efficiency of the illumination device is above 40%.

16. The light fixture according to claim 1, wherein the light collector comprises a plurality of lenslets adapted to collect light from the plurality of light sources and adapted to convert the collected light into a plurality of light beams so that the light beams propagate along said optical axis, where each of said lenslets comprises an entrance surface where said light enters the lenslet and an exit surface where the light exits the lenslet.

17. The light fixture according to claim 16, wherein:

each lenslet in the plurality of lenslets is a total internal reflection (TIR) lens; or the plurality of lenslets comprises two arrays of plano aspherical lenses on top each other; or the plurality of lenslets in the light collector form a one-piece molded glass element comprising a flange adapted for mechanical fixation of the light collector.

18. The light fixture according to claim 1, further comprising one or more actuators for changing a direction of light emitted from the light fixture.

19. The light fixture according to claim 1, wherein an illuminance of each light source of the plurality of light sources is above 250 $lm/mm^2$.

* * * * *